US008142089B2

(12) United States Patent
Wakiyama

(10) Patent No.: US 8,142,089 B2
(45) Date of Patent: Mar. 27, 2012

(54) IMAGE FORMING APPARATUS AND SHEET CONTAINING APPARATUS

(75) Inventor: Eiji Wakiyama, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 578 days.

(21) Appl. No.: 11/670,196

(22) Filed: Feb. 1, 2007

(65) Prior Publication Data

US 2007/0182802 A1 Aug. 9, 2007

(30) Foreign Application Priority Data

Feb. 7, 2006 (JP) ..... 2006-029929

(51) Int. Cl.
*B41J 2/01* (2006.01)
*B65H 1/14* (2006.01)
*G03G 15/00* (2006.01)

(52) U.S. Cl. ..... 400/691; 271/145; 347/104

(58) Field of Classification Search ..... 271/145, 271/171, 265.02; 400/691; 347/104; 206/215, 206/449, 455

See application file for complete search history.

(56) References Cited

U.S. PATENT DOCUMENTS 5,676,370 A * 10/1997 Taniguchi et al. ..... 271/265.02
2004/0041887 A1* 3/2004 Beilman et al. ..... 347/86

FOREIGN PATENT DOCUMENTS

| | | |
|---|---|---|
| JP | 09-086679 | 3/1997 |
| JP | 2000-56657 | 2/2000 |
| JP | 2001-063193 | 3/2001 |
| JP | 2002-243403 | 8/2002 |
| JP | 2003-107964 | 4/2003 |
| JP | 2003-212360 | 7/2003 |

* cited by examiner

*Primary Examiner* — Daniel J Colilla
*Assistant Examiner* — Marissa Ferguson Samreth
(74) *Attorney, Agent, or Firm* — Fitzpatrick, Cella, Harper & Scinto

(57) ABSTRACT

A protecting member is detachably mounted to an inside of an apparatus main body so as to protect a protected member in the apparatus main body during transportation. A fixing member fixes a protecting member in a position to protect the protected member. The fixing member fixing the protecting member covers a part of an indicating portion, which displays operating instructions of the apparatus main body.

13 Claims, 8 Drawing Sheets

IMAGE FORMING APPARATUS AND SHEET CONTAINING APPARATUS

BACKGROUND OF THE INVENTION

1. Field of the Invention

The present invention relates to an image forming apparatus, and in particular to an image forming apparatus in which a protecting member is detachably attached to an inside of the apparatus main body to protect a protected member in the apparatus main body when the image forming apparatus is transported.

2. Description of the Related Art

An image forming apparatus such as a conventional copier, a printer, or a facsimile machine, is detachably attached with a protecting member inside of the apparatus main body so as to prevent the displacement, deformation, and other damages of the members in the apparatus main body due to vibration during transportation when the image forming apparatus is packed and shipped.

On the other hand, during transportation, for example, a process cartridge, which can be attached to and removed from the image forming apparatus main body, is transported separately from the image forming apparatus. In the process cartridge, a photosensitive drum, which is a protected member, is protected during transportation by an openable and closable shutter unit, which is a protecting member.

This process cartridge includes a sealing unit for preventing the leakage of the developer before use. The sealing unit closes the shutter unit during transportation. In other words, during transportation, the sealing unit as a fixing unit fixes the shutter unit into a state in which the photosensitive drum is protected by the shutter unit.

When mounting the process cartridge in the image forming apparatus main body, a user removes the sealing unit, and thereby the shutter unit can be opened and closed. In this state, the process cartridge can be mounted to the image forming apparatus main body. However, when the user fails to remove the sealing unit, since the shutter unit cannot be opened or closed, the process cartridge cannot be mounted to the image forming apparatus main body.

This means that the process cartridge cannot be mounted to the image forming apparatus main body unless the sealing unit is removed. Causing the process cartridge not to be mountable unless the sealing unit is removed, allows the user to notice the removal of the sealing unit (see Japanese Patent Application Laid-Open No. 2000-56657 (Page 9, FIG. 1)).

In some sheet feeding cassettes, a buffer material, which regulates the movement of a side fence during transportation, is fixed to a sheet feeding tray with a filament tape and the like (see Japanese Patent Application Laid-Open No. H09-086679).

In the image forming apparatus disclosed in Japanese Patent Application Laid-Open No. 2000-56657, for the detachably mountable components such as a process cartridge, an inability to mount the component on the image forming apparatus allows the user to notice the necessity of removing the sealing unit.

However, there are cases that the user cannot recognize the presence of a fixing unit when a protecting member as the fixing unit is detachably mounted in the apparatus main body for protecting the protected member in the apparatus main body. Even in the case of Japanese Patent Application Laid-Open No. H09-086679, the user may fail to remove the buffer material serving as a protecting member. In this case, the protecting member will be left mounted in the apparatus main body. When the apparatus main body is driven with the protecting member thus being left mounted, the apparatus main body cannot work normally.

SUMMARY OF THE INVENTION

In view of the above, it is an object of the present invention to provide an image forming apparatus, which can reliably remove a protecting member, which has been attached to an apparatus main body during transportation, before starting the driving of the apparatus main body.

An image forming apparatus according to the present invention having a protecting member detachably attached for protecting a protected member of the apparatus main body during transportation of the apparatus main body, the image forming apparatus including:

a fixing member, which fixes the protecting member in a position for protecting the protected member; and an indicating portion, which displays operating instructions of the apparatus main body, wherein the fixing member covers at least a part of the indicating portion.

A sheet containing apparatus according to the present invention, detachably mounted to an image forming apparatus main body and having a protecting member detachably attached for protecting a protected member of the apparatus main body during transportation, the sheet containing apparatus comprising:

a fixing member, which fixes the protecting member in a position for protecting the protected member; and an indicating portion for displaying operating instructions of the sheet containing apparatus, wherein the fixing member covers at least a part of the indicating portion.

DESCRIPTION OF THE EMBODIMENTS

Hereinafter, the present invention will be described with reference to exemplary embodiments. However, the components described in the embodiments are just for exemplary purpose and not intended to limit the scope of the invention only thereto, unless restrictive descriptions are given in particular.

Figure 1:
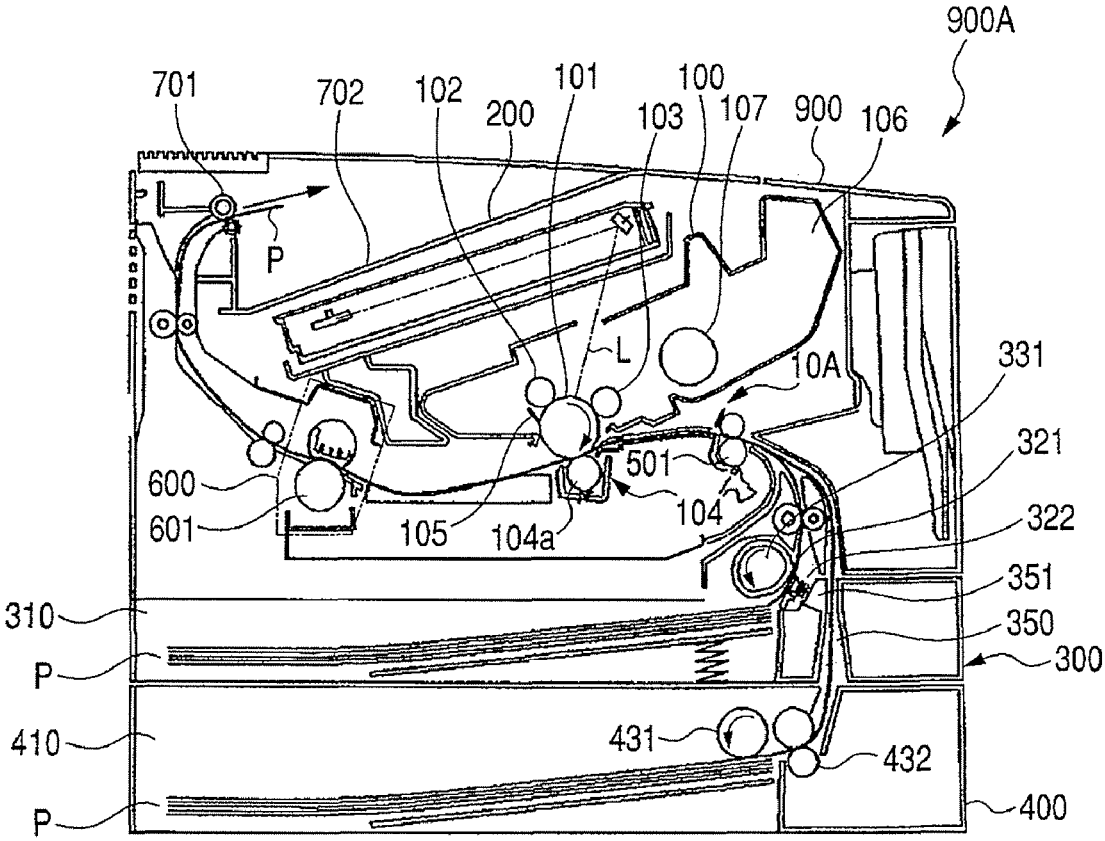
FIG. 1 is a view illustrating a schematic construction of a laser beam printer, which is an example of an image forming apparatus according to a first embodiment of the present invention.

FIG. 1 is a view illustrating a schematic construction of a laser beam printer, which is an example of an image forming apparatus according to a first embodiment of the present invention.

Referring to FIG. 1, a laser beam printer 900A includes a laser beam printer main body (hereinafter, referred to as a "printer main body") 900. An option feeder 400 is detachably mounted to the bottom surface of the printer main body 900.

The laser beam printer 900A includes an image forming portion 10A, a sheet feeder 300 for feeding a sheet P to the image forming portion 10A, a fixing portion 600 for fixing a toner image transferred on the sheet P at a transfer portion 104.

The image forming portion 10A is provided with a process cartridge 100 in a detachable manner. The process cartridge 100 has a photosensitive drum 101, a charging roller 102, a developing roller 103, a cleaning unit 105, a toner containing portion 106, and a toner agitating unit 107. The image forming portion 10A is also provided with a laser scanner 200, which exposes the surface of the photosensitive drum 101 to form an electrostatic latent image on the photosensitive drum 101.

Incidentally, the charging roller 102 is a charging unit for uniformly charging the surface of the photosensitive drum 101. The developing roller 103 is a developing unit for attaching toner to the electrostatic latent image formed by the laser scanner 200 to visualize it as a toner image. The cleaning unit 105 removes the toner remaining on the surface of the photosensitive drum 101 after the transfer of the toner image.

The sheet feeder 300 is disposed below the printer main body 900 and includes a sheet feeding cassette 310, which is a sheet containing apparatus detachably mounted to the printer main body 900, and a feed roller 331 in a semilunar shape for feeding sheets P on the sheet feeding cassette one by one. Further, the sheet feeding cassette 310 includes a separation pad 321, which is a separation unit.

Incidentally, the option feeder 400, disposed below the sheet feeder 300, also includes a sheet feeding cassette 410 and a feed roller 431 for feeding sheets P on the sheet feeding cassette one by one. Further, the option feeder 400 includes a separation roller pair 432 as a separation unit.

The transfer portion 104 includes a photosensitive drum 101 and a transfer roller 104*a*, which is in pressure contact with the photosensitive drum 101 to form a transfer nip and transfers the toner image on the photosensitive drum onto the sheet P when the sheet P passes the transfer nip.

The operation of image formation in the laser beam printer 900A thus constructed will be described hereinafter.

When the operation of image formation is started, the photosensitive drum 101 first rotates in a direction indicated by the arrow, and is uniformly charged to a predetermined polarity and a predetermined potential by the charging roller 102, to which the power is supplied by a high voltage power supply source (not shown). Then, the photosensitive drum 101 after the surface thereof is charged is irradiated with laser light L from the laser scanner 200 based on the image information, and thereby an electrostatic latent image is formed on the photosensitive drum 101.

Next, in association with the rotation of the developing roller 103, the adequately charged toner is supplied onto the photosensitive drum 101 and adheres to the electrostatic latent image, and thereby the electrostatic latent image is developed and visualized as a toner image.

On the other hand, when the sheet feeder 300 is designated to feed the sheet P, for example, in parallel with the operation of the toner image formation, the sheet P, which is stacked and contained in the sheet feeding cassette 310, is fed by a feed roller 331 at a predetermined time. The feed roller 331 maintains a position which is not in contact with the separation pad 321 during stand-by, and rotates through one revolution when the operation of image formation is started. The sheet P fed in association with this revolution is conveyed while nipped between the separation pad 321 and the feed roller 331.

Here, when sheets P are fed while overlapped with one another, the separation pad 321 restricts the conveyance of a sheet P on the side of the separation pad, and thus a sheet P only on the side of the feed roller is conveyed. With this, the sheets P which are stacked and contained in the sheet feeding cassette 310 are conveyed to a registration roller pair 501 one by one without being overlapped with one another.

On the other hand, when the option feeder 400 is designated to feed the sheet P, the sheet P, which is stacked and contained in the sheet feeding cassette 410, is fed by a feed roller 431 at a predetermined time. Then, the sheet P thus fed by the feed roller 431 is conveyed separately one by one by the separation roller pair 432 without being overlapped with one another.

The thus separately conveyed sheet P passes a sheet conveying path 350, which is disposed downstream of the separation pad 321 of the sheet feeding cassette 310 in the sheet feeding direction and extends in the vertical direction, and then is conveyed upward to the registration roller pair 501.

The sheet P is thus conveyed to the registration roller pair 501, and then the skew feed of the sheet P is corrected by the registration roller pair 501. Thereafter, the registration roller pair 501 adjusts the timing so that the leading edge of the sheet P is registered with the leading edge of the toner image formed on the surface of the photosensitive drum 101 to convey the sheet P to the transfer portion 104. Then, the toner image on the surface of the photosensitive drum 101 is transferred by the transfer roller 104*a* onto the sheet P thus conveyed.

Thereafter, the sheet P on which the toner image is transferred is conveyed to the fixing device 600, and a fixing roller pair 601 fixes the transferred toner image on the sheet P. The sheet P fixed with the toner image is then conveyed to a sheet discharging roller pair 701, which is disposed downstream of the fixing device 600 in the sheet feeding direction. Then, the sheet discharging roller pair 701 discharges the sheet P onto a sheet discharging tray 702, which is disposed in the upper portion of the apparatus main body 900.

Figure 2:
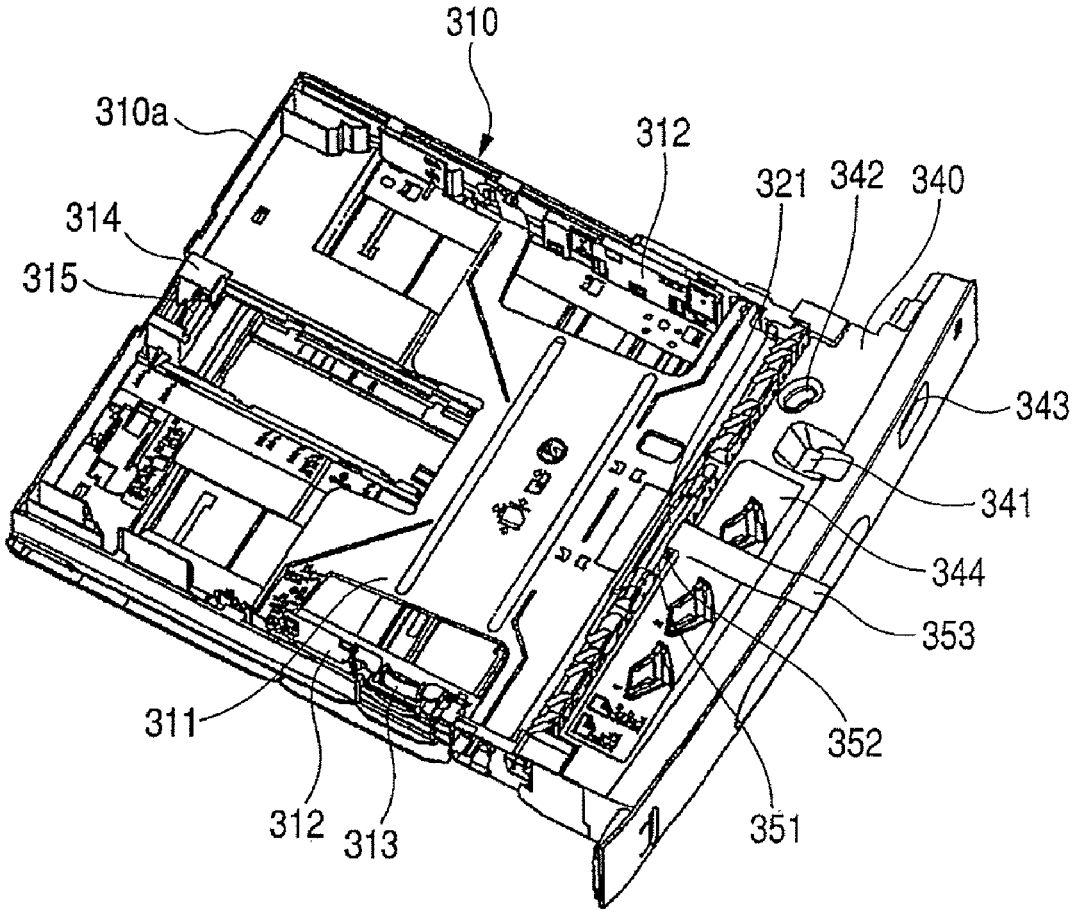
FIG. 2 is a perspective view illustrating a construction of a sheet feeding cassette, which is detachably mounted to the laser beam printer.

FIG. 2 is a perspective view illustrating a construction of the sheet feeding cassette 310. The sheet feeding cassette 310 includes a sheet containing portion 310*a*, which contains the sheet, and a cassette inner plate 311, which is rotatably provided in the sheet containing portion 310*a* and stacks and contains the sheets P. The sheet feeding cassette 310 further includes side edge regulating plates 312, which are side edge regulating members for regulating the positions of both side edges of the sheet P, and a rear edge regulating plate 314, which is a rear edge regulating member for regulating the position of the rear edge of the sheet P.

Figure 3:
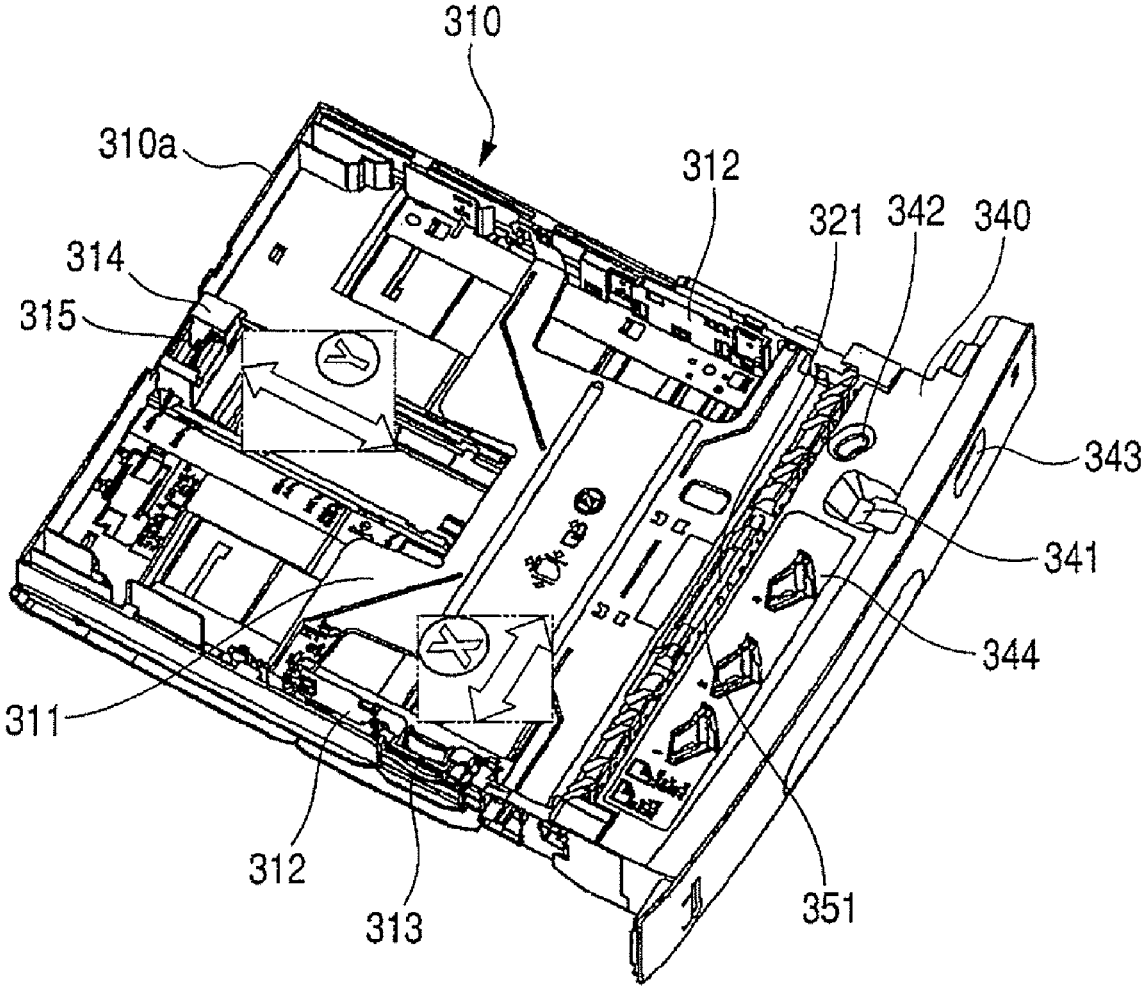
FIG. 3 is a perspective view illustrating operating instructions of a side edge regulating plate and a rear edge regulating plate provided in the sheet feeding cassette.

The side edge regulating plate 312 is designed to change the position by pinching and moving a side edge regulating plate lever 313 in an X direction, which is a width direction of the sheet P shown in FIG. 3. The rear edge regulating plate 314 is designed to change the position by pinching and moving a rear edge regulating plate lever 315 in a Y direction, which is a longitudinal direction of the sheet P.

The front panel 340, which forms the front portion of the sheet feeding cassette 310, is provided with a size switching roller 341 and a size switching lever 342 for setting (designating) the size of the sheet P. The user can change the setting of the size of the sheet P by operating the size switching roller 341 and the size switching lever 342 while confirming the size of the sheet P indicated on a size indicating window 343.

Figure 4:
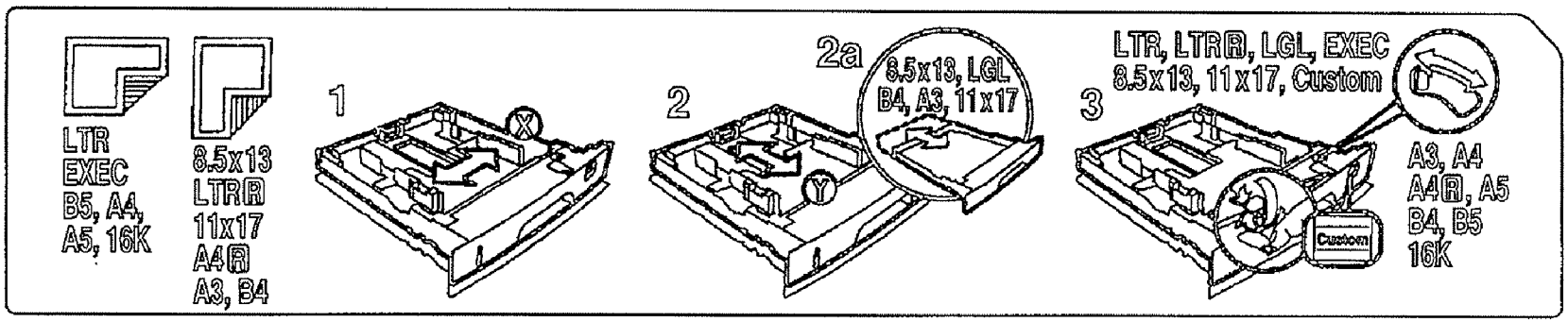
FIG. 4 is an enlarged view of an operating instruction display label illustrating operating instructions of a side edge regulating plate, a rear edge regulating plate, a size switching roller, and a size switching lever provided in the sheet feeding cassette.

Referring to FIGS. 2 and 3, an operating-instruction indicating label 344, which is an example of the indicating portion, is attached on the upper surface of the front panel 340. The operating-instruction indicating label 344 is visible before starting of the driving of the printer main body 900. On the operating-instruction indicating label 344, operating instructions for the side edge regulating plates 312, the rear edge regulating plate 314, the size switching roller 341 and the size switching lever 342 are indicated, as shown in FIG. 4. The operating-instruction indicating label 344 serves as an indicating portion for indicating operating instructions of the apparatus main body or the sheet containing apparatus.

For example, an item denoted by the numeral 1 on the operating-instruction indicating label 344 in FIG. 4 indicates that the position of the sheet P in width direction can be changed by moving the side edge regulating plate 312 in the X direction. An item denoted by the numeral 2 indicates that the position of the sheet P in the longitudinal direction can be changed by moving the rear edge regulating plate 314 in the Y direction.

And, an item denoted by the numeral 3 indicates that the size setting of the sheet P can be changed by moving the size switching roller 341 and the size switching lever 342 in respective directions indicated by the arrows while confirming the size in the size indicating window 343.

According to the instructions on the operating-instruction indicating label 344, before starting the driving of the printer main body 900, the user moves the side edge regulating plate 312 and the rear edge regulating plate 314 corresponding to the size of the sheet P to be contained. Further, the user moves the size switching roller 341 and the size switching lever 342 to change the size setting of the sheet P.

Figure 5:
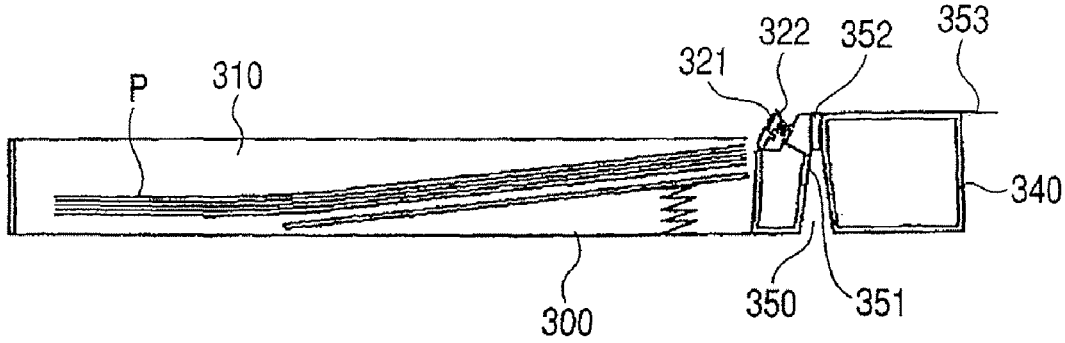
FIG. 5 is a view illustrating a state in which a protective spacer is attached to the sheet feeding cassette.

A separation pad 321 is provided on the downstream side of the sheet feeding cassette 310 in the sheet feeding direction. The separation pad 321 separates the sheets P together with the feed roller 331 described above, as shown in FIG. 5. On the opposite side to the conveying surface of the separation pad 321, a separation spring 322 is provided for bringing the separation pad 321 into pressure contact with the feed roller 331.

On the other hand, in the vicinity of the separation pad 321 between the separation pad 321 and the front panel 340, a path member 351 is provided, which forms a sheet conveying path 350 through which the sheet P fed from the option feeder 400 passes.

Here, one end of the separation spring 322 is in contact with the path member 351, and thereby the path member 351 is constantly under load of the separation spring 322. Therefore, displacement or deformation of the path member 351 as a protected member may be caused during the packing and transporting of, for example, the laser beam printer 900A. In order to prevent these problems, a protective spacer 352 as a protecting member, which is a plate member formed of a material such as expanded polystyrene, is set in the sheet conveying path 350. The protective spacer 352 is detachably attached in the sheet conveying path 350.

Figure 6:
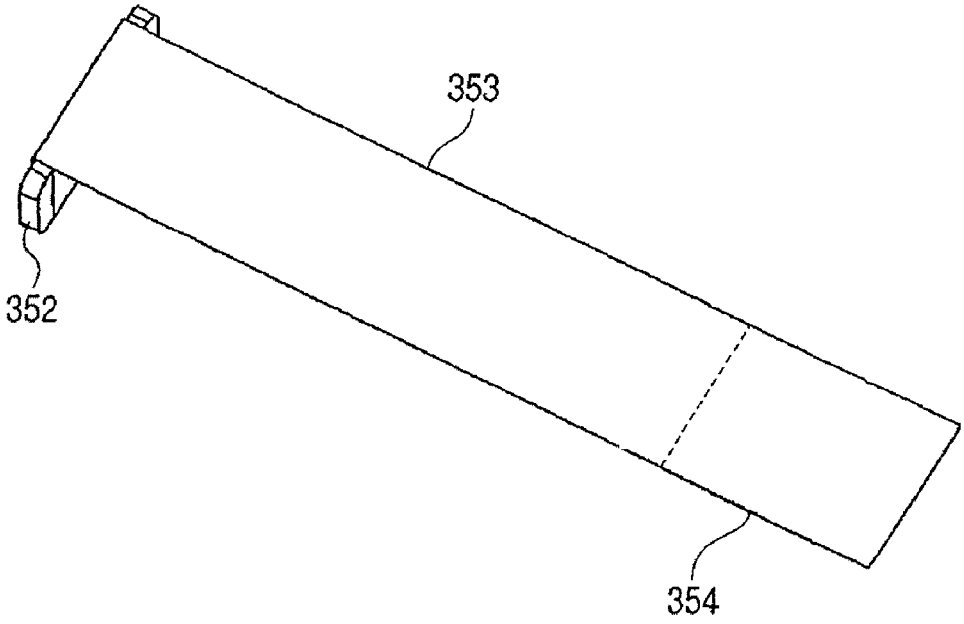
FIG. 6 is a perspective view illustrating a state in which an adhesive tape for fixation is attached to the protective spacer.

The protective spacer 352 is fixed in the sheet conveying path with an opaque adhesive tape 353 for fixation, which is a tape-shaped fixing member as shown in FIG. 6. The one end portion of the adhesive tape 353 for fixation winds around the protective spacer 352, and the other end of the adhesive tape 353 for fixation is folded back by approximately one centimeter as a tear strip margin 354, as shown in FIG. 6.

When the protective spacer 352 is set in the sheet conveying path 350, the adhesive tape 353 for fixation is drawn out upward as shown in FIG. 2, and one end portion thereof is attached on the front panel 340 so as to cover at least a part of the operating-instruction indicating label 344.

Here, when the adhesive tape 353 for fixation is thus attached, the user will strip off the adhesive tape 353 for fixation to confirm (visually recognize) a part of the operating-instruction indicating label 344 when setting the sheets in the sheet feeding cassette 310. In this embodiment, the opaque adhesive tape 353 for fixation is used to cover the operating-instruction indicating label 344. This allows the user to confirm a part of the operating-instruction indicating label 344 when setting the sheets in the sheet feeding cassette 310 before starting the driving of the printer main body 900, and thereby the user will reliably strip off the adhesive tape 353.

Then, when the adhesive tape 353 for fixation is thus stripped off, since the protective spacer 352 is wound around by the adhesive tape 353, the removal of the adhesive tape 353 allows removing of the protective spacer 352 together with the adhesive tape 353.

Figure 7:
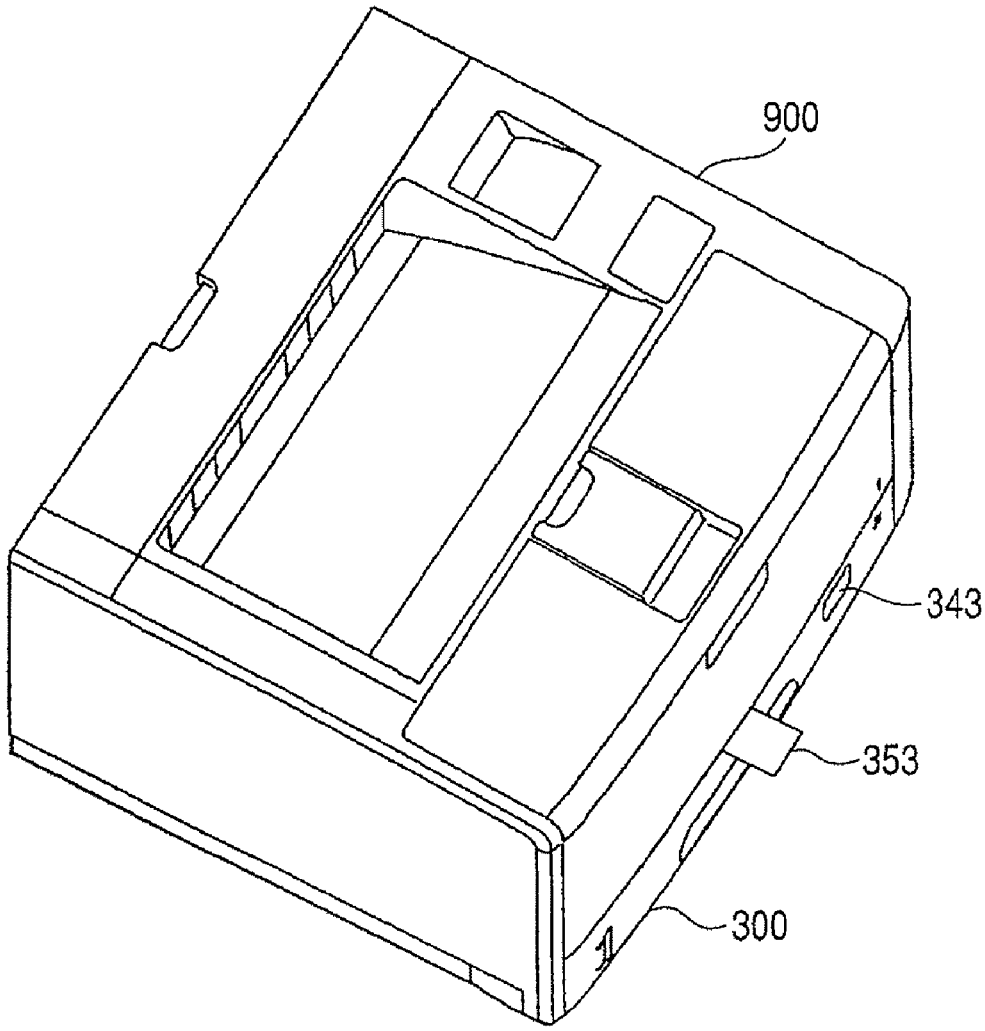
FIG. 7 is a perspective view illustrating a state in which one end portion of the adhesive tape for fixation is exposed to outside of the apparatus main body.

According to the embodiment, the adhesive tape 353 for fixation is attached to the apparatus main body so that the one end portion of the adhesive tape 353 with the tear strip margin 354 is exposed outside the apparatus, as shown in FIG. 7. This makes the user easily recognize the presence of the adhesive tape 353 and thereby remove the adhesive tape 353. As a result, the protective spacer 352 can be reliably removed.

The path member 351 can be protected by fixing the protective spacer 352, which is attached inside the printer main body 900, in the sheet conveying path with the adhesive tape 353 for fixation during transportation. Further, the user can recognize the presence of the adhesive tape 353 before starting the driving of the printer main body 900 by covering at least a part of the operating-instruction indicating label 344 with the adhesive tape 353. As a result, the protective spacer 352 attached to the printer main body 900 during transportation can be reliably removed together with the adhesive tape 353 for fixation before starting the driving of the printer main body 900, thereby achieving normal operation of the printer main body 900.

Also, although in the description mentioned above, the separation pad 321 is used as a separation unit for separating the sheets P, a separation roller with a torque limiter, for example, may also be used as a separation unit.

An image forming apparatus according to a second embodiment of the present invention, in which a separation roller is used as a separation unit, will be described hereinafter.

Figure 8:
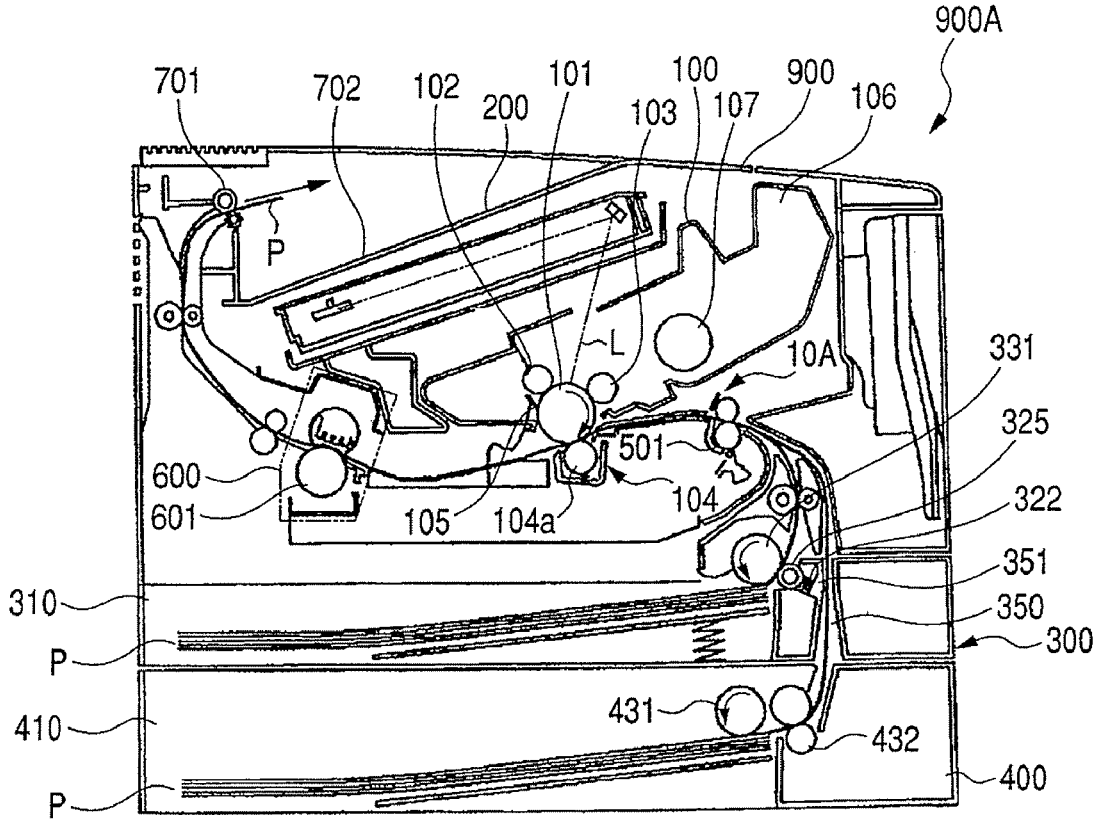
FIG. 8 is a view illustrating a schematic construction of a laser beam printer, which is an example of an image forming apparatus according to a second embodiment of the present invention.

FIG. 8 is a view illustrating a schematic construction of a laser beam printer, which is an example of an image forming apparatus according to the second embodiment. In FIG. 8, similar numerals will be used to designate the similar or corresponding elements as shown in FIG. 1.

In FIG. 8, a separation roller 325 forms a separation portion, which is in pressure contact with a cylinder-shaped feed roller 331 and separates the sheets. Here, in this embodiment, the feed roller 331 is designed to be rotated by a drive power from a drive unit (not shown) in the apparatus main body 900 via a clutch (not shown). Note that, in this embodiment, the feed roller 331 is designed to be rotated by the drive power from the drive unit when the clutch is in the turned-on state and to idle when the clutch is in the turned-off state.

The separation roller 325 includes a torque limiter (not shown), which restricts the rotation of the separation roller 325. To rotate the separation roller 325, a predetermined amount of rotation torque must be applied to the torque limiter. Owing to this, when there is a sheet between the feed roller 331 and the separation roller 325, a large amount of rotation torque is applied to the torque limiter so that the torque limiter allows the separation roller 325 to rotate in association with the feed roller 331. Thus, the sheets are conveyed.

When there is a plurality of sheets between the feed roller 331 and the separation roller 325, since a relatively small amount of rotation torque is applied to the torque limiter, the torque limiter inhibits the associated rotation of the separation roller 325. As the associated rotation of the separation roller 325 is thus inhibited, the feed roller 331 feeds one sheet and the separation roller 325 blocks feeding of the other sheets.

In the sheet feeder 300 including the separation roller 325 as described above, when the image formation operation is started, the clutch is turned on to rotate the feed roller 331 and the sheets P, which are stacked and contained in the containing cassette 310, are fed. Then, the sheet P thus fed is conveyed while nipped between the separation roller 325 and the feed roller 331.

Here, when the sheets P are conveyed while being overlapped with one another, the torque limiter acts to restrict the conveyance of a sheet P on the side of the separation roller so that only a sheet P on the side of the feed roller is conveyed. With this, the sheets P which are stacked and contained in the containing cassette 310 are conveyed one by one to the registration roller pair 501 without being overlapped with one another.

Figure 9:
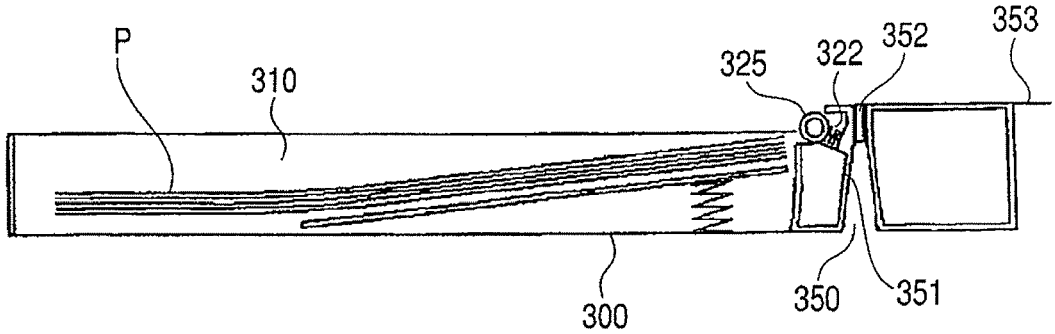
FIG. 9 is a view illustrating a state in which a protective spacer is attached to the sheet feeding cassette, which is detachably mounted to the laser beam printer.

Also, on the opposite side of the conveying surface of the separation roller 325, a separation spring 322 is provided for urging the separation roller 325 to the feed roller 331 as shown in FIG. 9. Since one end of the separation spring 322 is in contact with the path member 351, the path member 351 is constantly under load of the cassette separation spring 322. Thereby, the displacement or deformation of the path member 351 may be caused during the packing and transportation of, for example, the laser beam printer 900A. In order to prevent these problems, a protective spacer 352 must be attached to the sheet conveying path 350.

Also, in this embodiment, the protective spacer 352 is fixed to the sheet conveying path 350 with the opaque adhesive tape 353 for fixation as shown in FIG. 6, so as to protect the path member 351. The adhesive tape 353 for fixation is attached so as to cover a part of the operating-instruction indicating label 344.

With this arrangement, as with the first embodiment described above, the user can recognize the presence of the adhesive tape 353 for fixation before starting the driving of the printer main body 900. As a result, the protecting member can be reliably removed together with the fixing unit, thereby achieving normal operation of the printer main body 900.

Although in the above description, as an example of the indicating portion, which can be visually recognized before starting of the driving of the printer main body 900, the operating-instruction indicating label 344, which is positioned in the vicinity of the path member 351 as a protected member, has been described, the present invention is not limited thereto. Namely, a part of the indicating portion in the vicinity of the protected member can be covered by a fixing member to obtain a similar effect.

In the present embodiment, the protecting member attached inside the apparatus main body is fixed at a position which protects the protected member with a tape-shaped fixing member during transportation, and a tape-shaped fixing member covers at least a part of the indicating portion, which is visually recognized before starting of driving of the apparatus main body. With this arrangement, the user can recognize the presence of the fixing member before starting of the driving of the apparatus main body. Therefore, the protecting member attached to the apparatus main body during transportation can be reliably removed together with the fixing member before starting of the driving of the apparatus main body.

This application claims the benefit of Japanese Patent Application No. 2006-029929, filed Feb. 7, 2006, which is hereby incorporated by reference herein in its entirety.

What is claimed is:

1. An image forming apparatus comprising:

an image forming portion, which forms an image on a sheet, provided on an apparatus main body; and a sheet containing apparatus which stores sheets to be fed to the image forming portion and which is detachably mountable to the apparatus main body, the sheet containing apparatus comprising:

a path member composing a sheet conveying path, wherein the sheet conveying path extends in a vertical direction, and sheets conveyed from below the sheet containing apparatus toward the image forming portion pass through the sheet conveying path;

a protecting member, which protects the path member during the transportation of the sheet containing apparatus, and which is detachably attached to the sheet conveying path;

an indication portion, which displays operating instructions of the sheet containing apparatus, and which is provided in a vicinity of the protecting member and on an upper surface of the sheet containing apparatus; and a tape-shaped fixing member configured to fix the protecting member in a position to protect the path member and to cover a part of the indication portion, wherein an end portion of the tape-shaped fixing member is wound around the protecting member.

2. An image forming apparatus according to claim 1, wherein the tape-shaped fixing member covers a part of the indication portion in a state that another end portion of the tape-shaped fixing member is exposed to an outside of the sheet containing apparatus.

3. An image forming apparatus according to claim 1, wherein the indication portion indicates operations to be performed before starting of a driving of the image forming apparatus.

4. An image forming apparatus according to claim 1, wherein the sheet containing apparatus includes:

a sheet containing portion that contains sheets; and a regulating member configured to regulate an edge position of the sheets contained in the sheet containing portion, wherein the indication portion displays an operation of the regulating member.

5. An image forming apparatus according to claim 4, wherein the protecting member is a plate member attached in the sheet conveying path to protect the path member, and the tape-shaped fixing member is an opaque adhesive tape configured to fix the protecting member.

6. An image forming apparatus according to claim 1, further comprising another sheet containing apparatus provided below the sheet containing apparatus, wherein the sheet conveying path is a path through which sheets fed from the another sheet containing apparatus are sent to the image forming portion.

7. An image forming apparatus according to claim 1, wherein the indication portion is a label on which the operating instructions of the sheet containing apparatus are indicated.

8. An image forming apparatus according to claim 1, wherein the protecting member is attached to the tape-shaped fixing member so that when the tape-shaped fixing member is removed from the sheet containing apparatus, the protecting member is removed together with the tape-shaped fixing member from the sheet containing apparatus.

9. A sheet containing apparatus, which is detachably mounted to an apparatus main body of an image forming apparatus, comprising:

a path member composing a sheet conveying path, wherein the sheet conveying path extends in a vertical direction, and sheets conveyed from below the sheet containing apparatus pass through the sheet conveying path;

a protecting member, which protects the path member during transportation of the sheet containing apparatus, and which is detachably attached to the sheet conveying path;

an indication portion, which displays operating instructions of the sheet containing apparatus, and which is provided in a vicinity of the protecting member and on an upper surface of the sheet containing apparatus; and a tape-shaped fixing member configured to fix the protecting member in a position to protect the path member and to cover a part of the indication portion, wherein an end portion of the tape-shaped fixing member is wound around the protecting member.

10. A sheet containing apparatus according to claim 9, further comprising:

a regulating member configured to regulate an edge position of contained sheets, wherein the indication portion displays operating instructions of the regulating member.

11. A sheet containing apparatus according to claim 9, wherein the tape-shaped fixing member covers a part of the indication portion in a state that another end portion of the tape-shaped fixing member is exposed to an outside of the apparatus main body.

12. A sheet containing apparatus according to claim 9, wherein the indication portion is a label on which the operating instructions of the sheet containing apparatus are indicated.

13. A sheet containing apparatus according to claim 9, wherein the protecting member is attached to the tape-shaped fixing member so that when the tape-shaped fixing member is removed from the sheet containing apparatus, the protecting member is removed together with the tape-shaped fixing member from the sheet containing apparatus.

* * * * *